US007442887B2

(12) United States Patent
Graham et al.

(10) Patent No.: US 7,442,887 B2
(45) Date of Patent: Oct. 28, 2008

(54) ENHANCED ROTARY MULTI-POLE ELECTRICAL SWITCH

(75) Inventors: Eric J. Graham, Bellingham, WA (US); Justin C. Kaufman, Bellingham, WA (US); Kevin L. Lacy, Bellingham, WA (US)

(73) Assignee: Blue Sea Systems, Inc., Bellingham, WA (US)

( * ) Notice: Subject to any disclaimer, the term of this patent is extended or adjusted under 35 U.S.C. 154(b) by 181 days.

(21) Appl. No.: 11/461,700

(22) Filed: Aug. 1, 2006

(65) Prior Publication Data

US 2007/0081676 A1 Apr. 12, 2007

Related U.S. Application Data

(60) Provisional application No. 60/720,641, filed on Sep. 26, 2005.

(51) Int. Cl.
*H01H 19/00* (2006.01)
*H01H 19/11* (2006.01)
*H01H 19/58* (2006.01)

(52) U.S. Cl. ..... 200/11 R; 200/336; 200/564

(58) Field of Classification Search ..... 200/11 R
See application file for complete search history.

(56) References Cited

U.S. PATENT DOCUMENTS 3,198,895 A * 8/1965 Richman ..... 200/14
5,008,498 A * 4/1991 Yamazaki ..... 200/11 R
5,252,791 A * 10/1993 Williams ..... 200/11 C
6,340,801 B1 * 1/2002 Fukuda et al. ..... 200/18
6,784,383 B2 * 8/2004 Sugahara et al. ..... 200/11 R

* cited by examiner

*Primary Examiner*—Elvin Enad
*Assistant Examiner*—Lheiren Mae A Anglo
(74) *Attorney, Agent, or Firm*—Brian L. Johnson; George C. Rondeau, Jr.; Davis Wright Tremaine LLP

(57) ABSTRACT

Implementations provide a first option of simultaneously turning on or turning off two distinctly separate and isolated electrical circuits, such as when each of two electrical devices are powered by a different energy source. Implementations provide a second option of connecting the two separate circuits together, such as when both of the first electrical device and the second electrical device are to be powered by both of the different energy sources connected in parallel. Included is an electrically isolative rotor internal to a housing. The rotor is keyed with an external knob used to control rotational position of the rotor. Further included are electrically conductive link bars contained by the rotatable rotor that electrically couple with stationary bus bars dependent upon rotational positioning of the rotor. Other implementations of the enhanced switch are envisioned including another depicted implementation discussed allowing for a double-pole, double-throw switch.

4 Claims, 18 Drawing Sheets

ENHANCED ROTARY MULTI-POLE ELECTRICAL SWITCH

CROSS REFERENCE TO RELATED APPLICATION

This application claims priority benefit of provisional application Ser. No. 60/720,641 filed Sep. 26, 2005.

BACKGROUND OF THE INVENTION

1. Field of the Invention

The present invention is generally related to electrical switches.

2. Description of the Related Art

Electrical switches are useful in providing options regarding which paths are available for electrical power to be routed from energy sources, such as batteries, to various electrical devices. Unfortunately, conventional switches can have limitations as to which options are provided and as to how saftely and reliably the options are provided.

BRIEF DESCRIPTION OF THE SEVERAL VIEWS OF THE DRAWING(S)

DETAILED DESCRIPTION OF THE INVENTION

Figure 1:
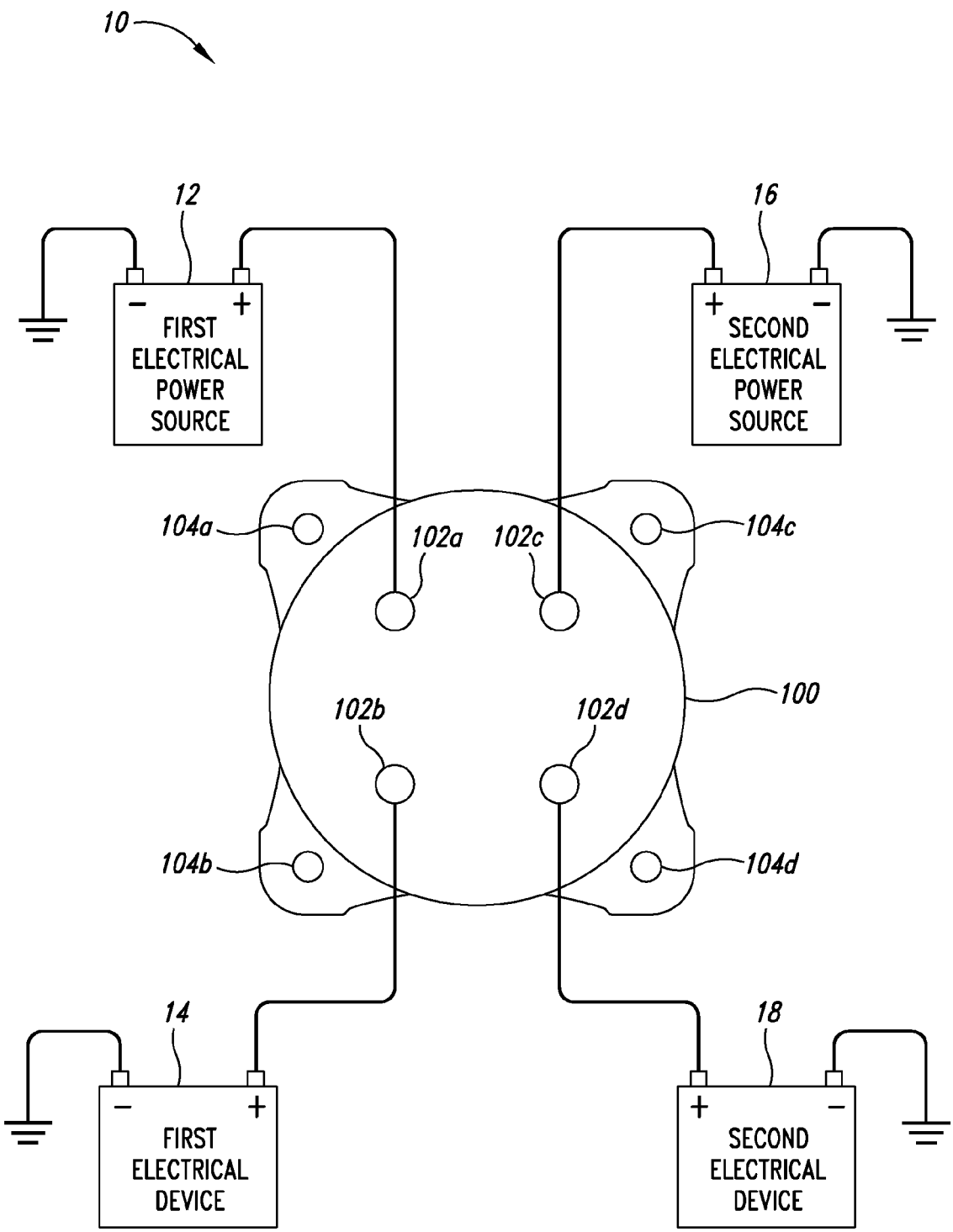
FIG. 1 is a schematic circuit diagram of an enhanced electrical rotary switch shown in an "off" switch position.

As discussed herein, a depicted implementation of an enhanced multi-pole electrical rotary switch provides a first option of simultaneously turning on or turning off two distinctly separate and insulated electrical circuits. The first option is useful in circumstances such as when a first electrical device is exclusively powered by a first power source such as a first battery and a second electrical device is exclusively powered by a second power source such as a second battery. The enhanced switch provides a second option of connecting the two separate circuits together.

The second option is useful in circumstances such as when both the first electrical device and the second electrical device are to be powered by both the first electrical power source and the second electrical power source connected in parallel. Included is an electrically isolative rotor internal to a housing. The rotor is keyed with an external knob used to control rotational position of the rotor as a shaft or other elongated member that is coupled to the rotor is rotated about a longitudinal axis of the shaft. Further included are electrically conductive link bars or link members that electrically couple with bus bars or bus members dependent upon rotational positioning of the rotor. Other implementations of the enhanced switch are envisioned including another depicted implementation discussed allowing for a double-pole double-throw switch A first implementation 100 of the enhanced switch is shown in schematic form in FIGS. 1-3 as being used in a representative circuit layout 10 including a first electrical power source 12, a first electrical device 14, a second electrical power source 16, and a second electrical device 18. The first implementation 100 has a first terminal 102*a*, a second terminal 102*b*, a third terminal 102*c*, and a fourth terminal 102*d* all being electrically conductive. The first implementation 100 includes a first bolthole 104*a*, a second bolthole 104*b*, a third bolthole 104*c*, and a fourth bolthole 104*d*. As depicted in the representative circuit layout 10, the first terminal 102*a* is electrically connected to the positive terminal of the first electrical power source 12, the second terminal 102*b* is electrically connected to the positive terminal of the first electrical device 14, the third terminal 102*c* is electrically connected to the positive terminal of the second electrical power source 16, and the fourth terminal 102*c* is electrically connected to the positive terminal of the second device 18.

The first implementation 100 is shown in FIG. 1 as being in an "off" condition such that no electrical paths exist between any of the first terminal 102*a*, the second terminal 102*b*, the third terminal 102*c*, and the fourth terminal 102*d*. For the depicted representative circuit 10, the first implementation 100 in the "off" condition prevents the first electrical device 14 from being powered by the first electrical power source 12 and/or the second electrical power source 16 and prevents the second electrical device 18 from being powered by the first electrical power source 12 and/or the second electrical power source 16

Figure 2:
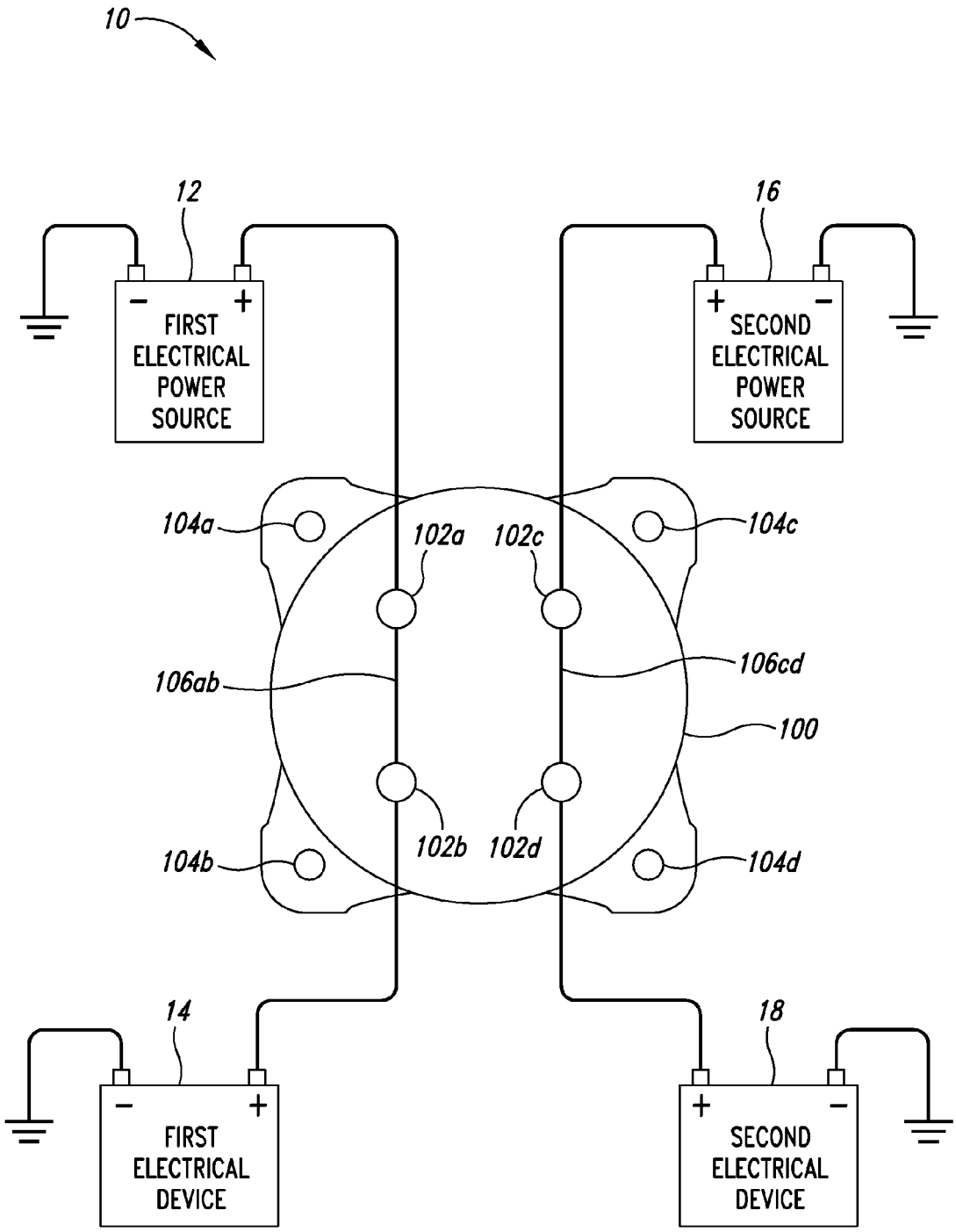
FIG. 2 is a schematic circuit diagram of the enhanced electrical rotary switch shown in an "on" switch position.

The first implementation 100 is shown in FIG. 2 as being in an "on" condition such that only two electrical paths exist between any of the first terminal 102*a*, the second terminal 102*b*, the third terminal 102*c*, and the fourth terminal 102*d*: a first electrical path 106*ab* between the first terminal 102*a* and the second terminal 102*b* and a second electrical path 106*cd* between the third terminal 102*c* and the fourth terminal 102*d*. For the depicted representative circuit 10, the first implementation 100 in the "on" condition allows the first electrical device 14 to be powered exclusively by the first electrical power source 12 through the first path 106*ab* and allows the second device 18 to be powered exclusively by the second electrical power source 16 through the second path 106*cd*.

Figure 3:
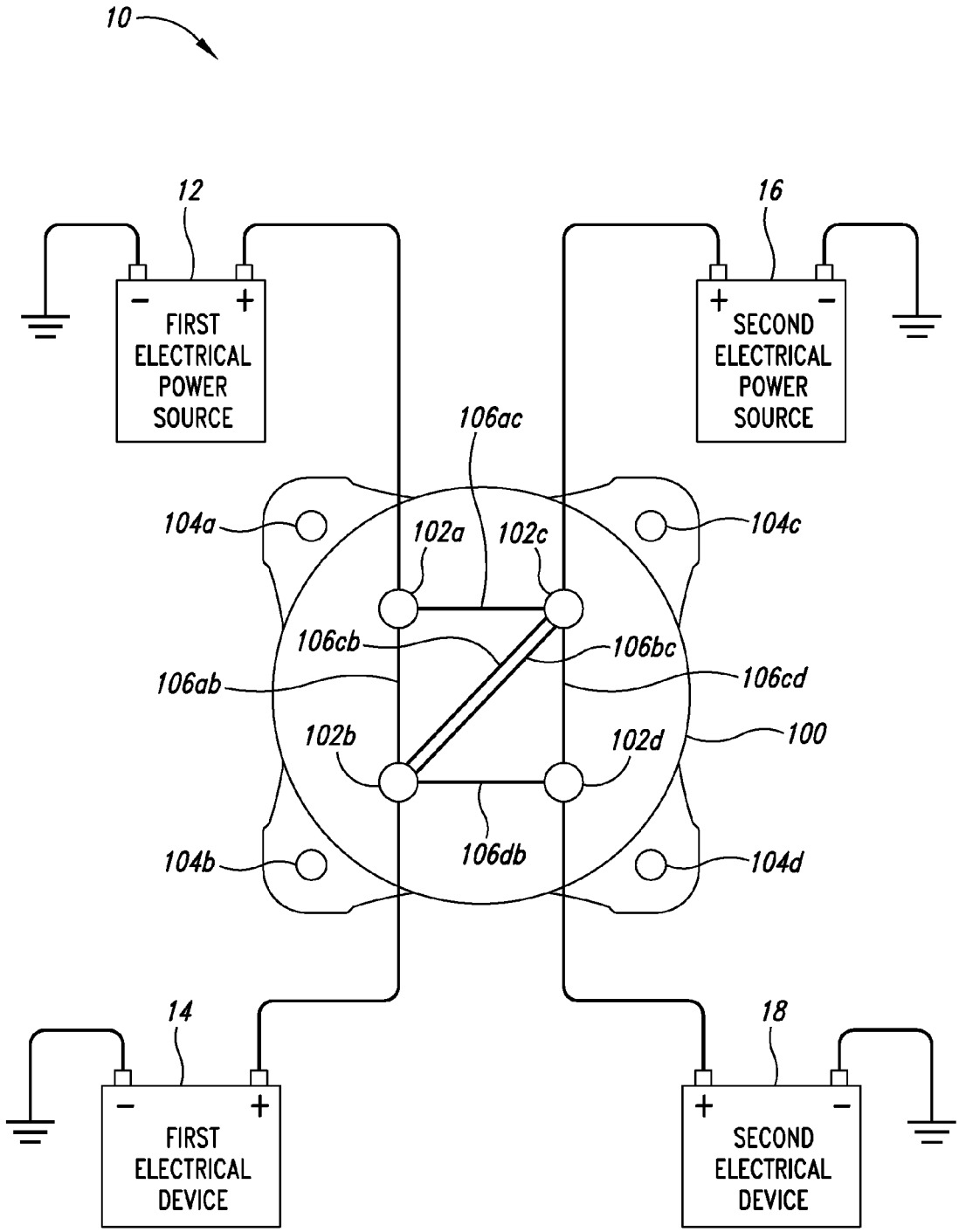
FIG. 3 is a schematic circuit diagram of the enhanced electrical rotary switch shown in a "both" switch position.

The first implementation 100 is shown in FIG. 3 as being in a "both" condition such that six electrical paths: the first electrical path 106*ab*, the second electrical path 106*cd*, a third electrical path 106*ac* between the first terminal 102*a* and the third terminal 102*c*, a fourth electrical path 106*bc* between the second terminal 102*b* and the third terminal 102*c*, a fifth electrical path 106 db between the fourth terminal 102*d* and the second terminal 102*b*, and a sixth electrical path 106*cb* between the third terminal 102*c* and the second terminal 102*b*.

For the depicted representative circuit 10, the first implementation 100 in the "both" condition allows the first electrical device 14 to be powered by the first electrical power source 12 through the first path 106*ab* and to be powered by the second electrical power source 16 through a first combined path of the third path 106*ac* and the first path 106*ab* and through a second combined path of the second path 106*cd* and the fourth path 106*db*. The first electrical device 14 is also powered by the second electrical power source 16 through the fourth path 106*bc* and the sixth path 106*cb*.

For the depicted representative circuit 10, the first implementation 100 in the "both" condition further allows the second electrical device 18 to be powered by the second electrical power source 16 through the second path 106*cd* and to be powered by the first electrical power source 12 through a third combined path of the third path 106*ac* and the second path 106*ad* and through a fourth combined path of the first path 106*ab* and the fifth path 106*db*.

Figure 4:
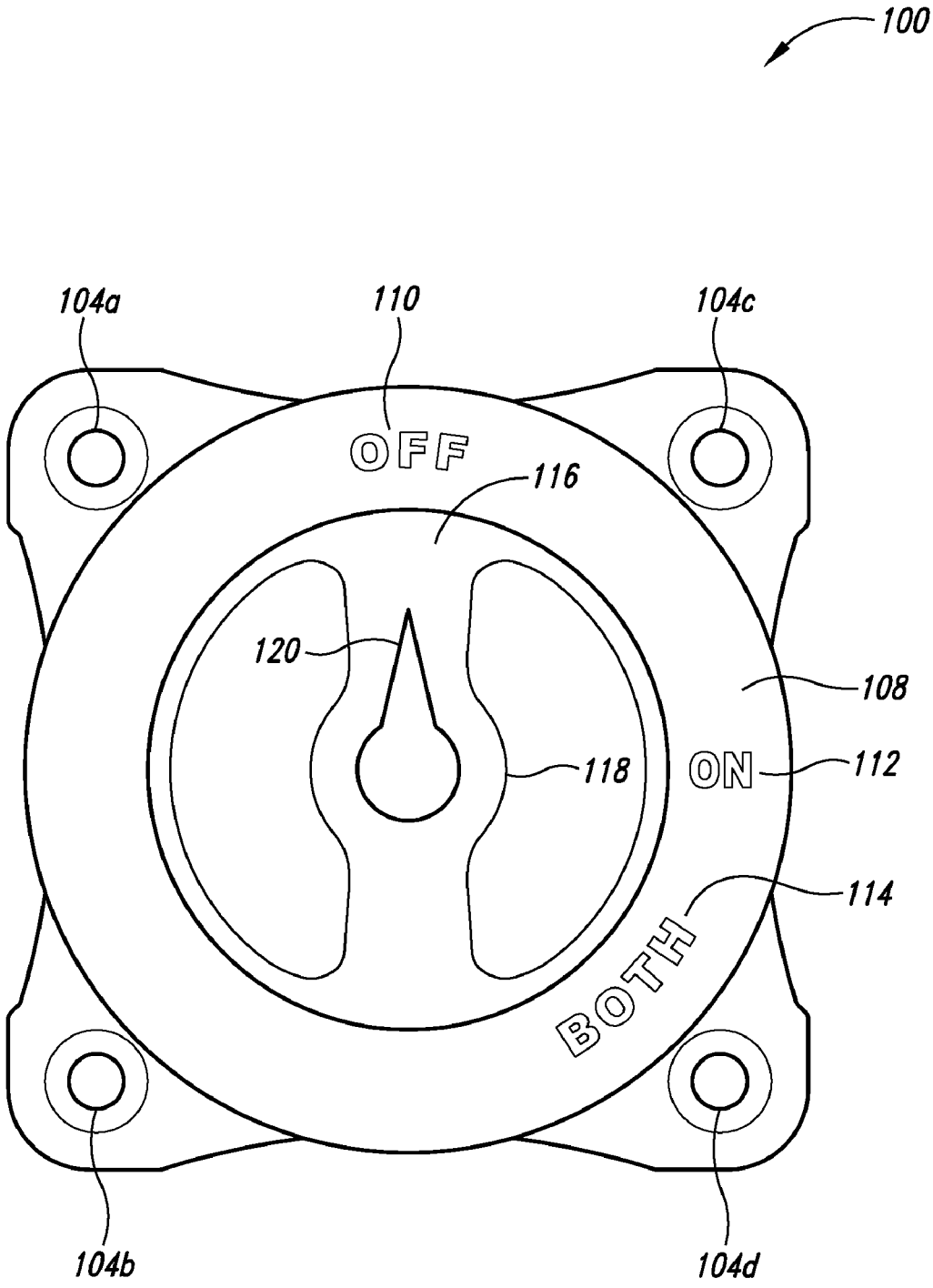
FIG. 4 is a top plan view of the enhanced electrical rotary switch.
Figure 5:
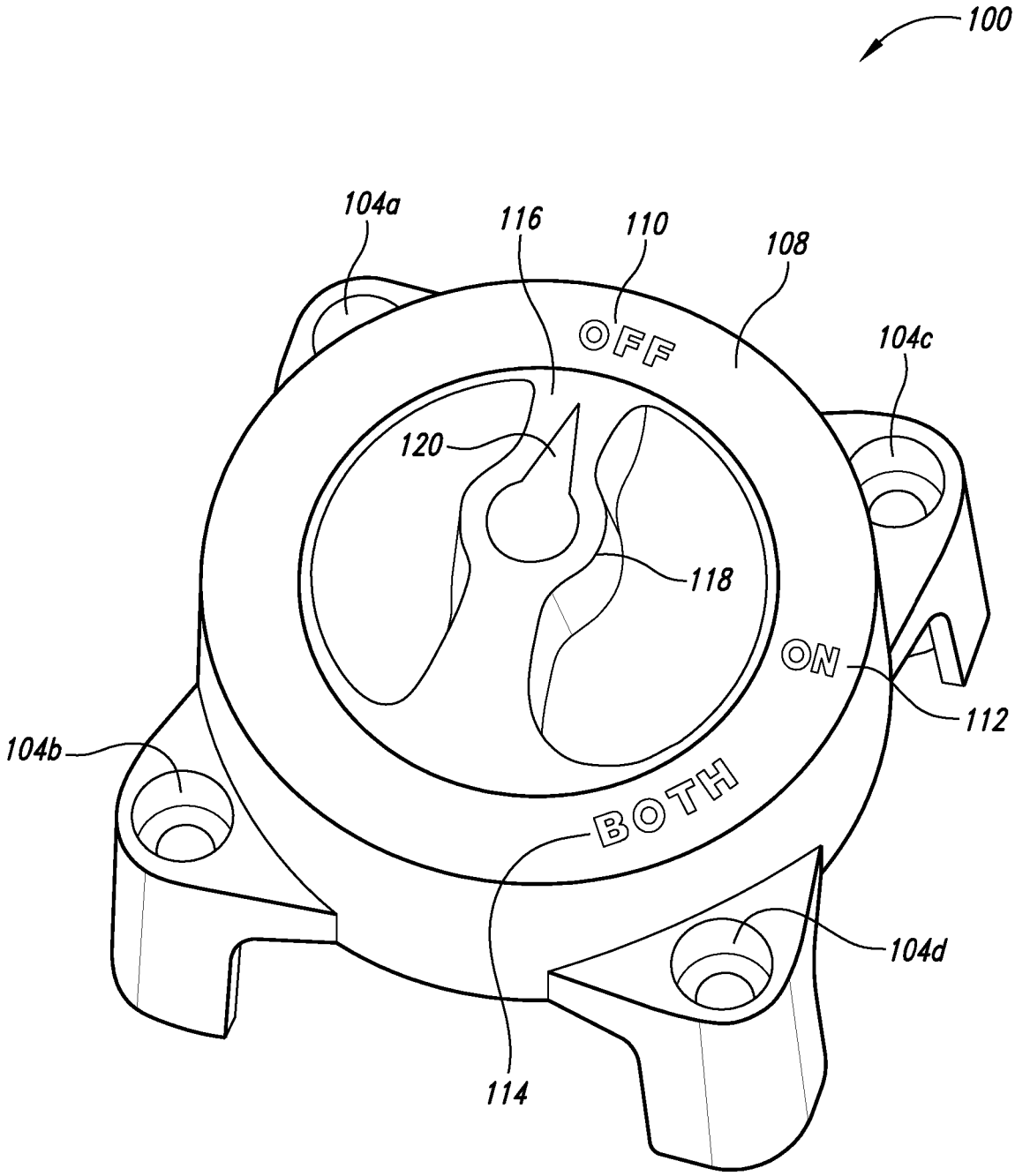
FIG. 5 is a perspective view of enhanced electrical rotary switch.

The first implementation 100 is shown in FIG. 4 and FIG. 5 as having a housing 108, which is electrically isolative and has an "off" position marking 110, an "on" position marking 112, and a "both" position marking 114. The first implementation 100 has a knob 116, which is electrically isolative and has a grip 118 and a pointer 120. In operation, a user grabs the grip 118 and rotates the knob 116 to select a desired condition for the implementation 100 as indicated by the pointer 120 pointing to the "off" position marking 110 when the implementation is in the "off" condition, the pointer pointing to the "on" position marking 112 when the implementation is in the "on" condition, and the pointer pointing to the "both" position marking 114 when the implementation is in the "both" condition.

Figure 6:
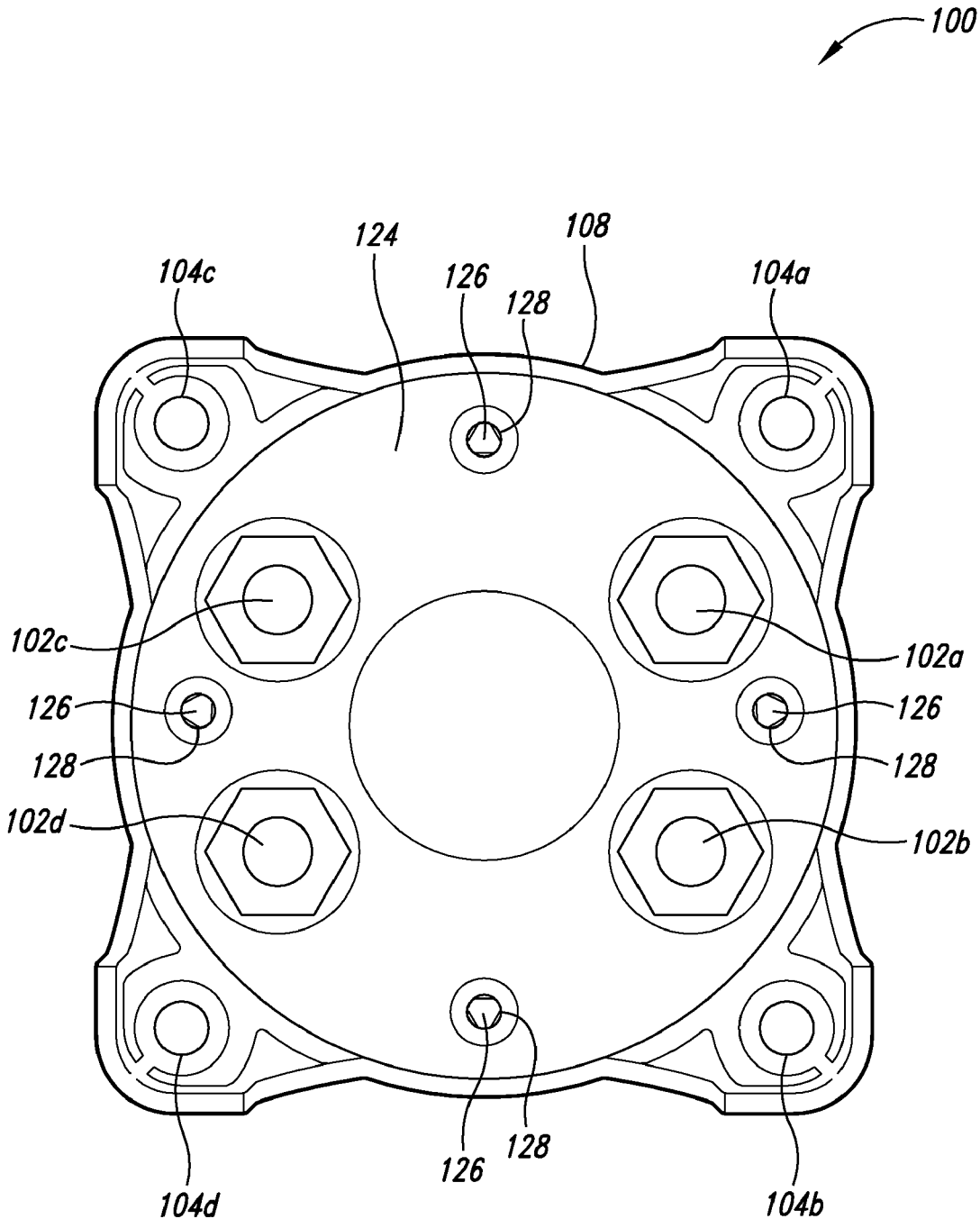
FIG. 6 is a bottom plan view of the enhanced electrical rotary switch.

The first implementation 100 is shown in FIG. 6 as having a backplate 124, which is electrically isolative and is coupled to the housing 108 by screws 126 positioned through screw holes 128 of the backplate and screwedly affixed to the housing.

Figure 7:
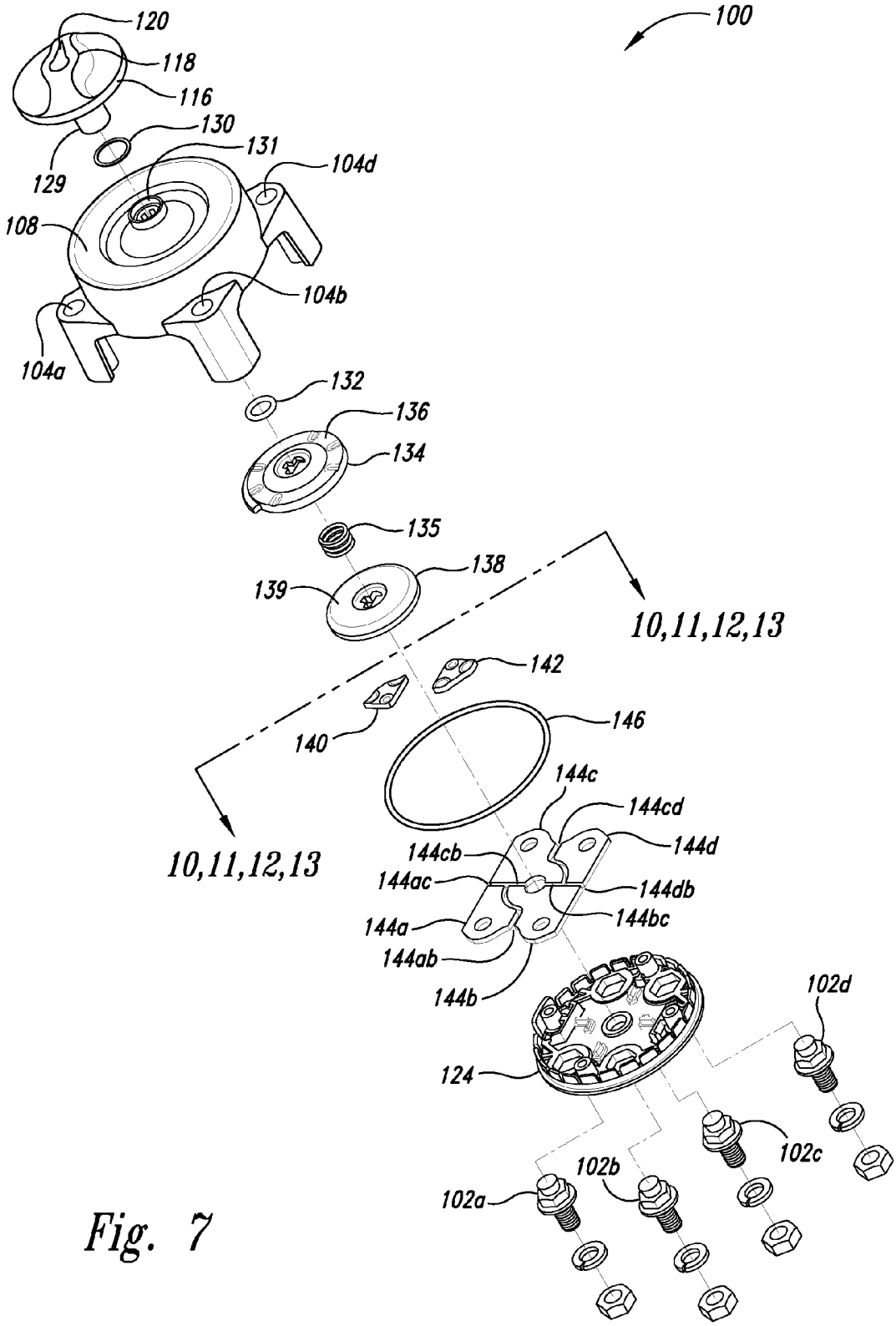
FIG. 7 is an exploded perspective view of the enhanced electrical rotary switch.

The first implementation 100 is shown with further detail in FIG. 7 with a keyed shaft 129 extending from the knob 116. When the first implementation 100 is assembled, the keyed shaft 129 first passes through an o-ring 130, which provides a watertight seal between the knob 116 and the housing 108. The shaft 129 passes through a hole 131 in the housing 108 and through a retaining ring 132, which retains the knob 116 with the housing.

The keyed shaft 129 further passes through a keyed collar 134 that is positioned adjacent an inner surface (not shown) of the housing. The keyed collar 134 has a peripheral member (not shown) that abuts against a first stop (not shown) extending from the inner surface of the housing 108 when the knob 116 is positioned in an "off" position with the pointer 120 pointing to the "off" position marking 110. The peripheral member abuts against a second stop (not shown) extending from the inner surface of the housing 108 when the knob 116 is positioned in a "both" position with the pointer 120 pointing to the "both" position marking 114. Consequently, the keyed collar 134 limits rotation of the knob 116 between the "off" position and the "both" position. Furthermore, when the knob 116 is rotated between the "off" position and the "both" position, the knob passes through an "on" position in which the pointer 120 is pointing to the "on" position marking 112.

When the implementation 100 is assembled, the keyed shaft 129 passes through a spring 135, which is compressed to maintain contact between a first side 136 of the keyed collar 134 and the housing 108. The keyed shaft 129 passes through a keyed rotor 138, which is electrically isolative and contains a first link bar 140 or lirk member and a second link bar 142, which are electrically conductive being made of copper, other metal or other conductive material. The keyed rotor 138 constrains the first link bar 140 and the second link bar 142 to be moveable in angular paths about the keyed shaft 129. The first link bar 140 and the second link bar 142 contact certain ones of a first bus bar 144*a* or link member, a second bus bar 144*b*, a third bus bar 144*c*, and a fourth bus bar 144*d* depending upon whether the knob 116 is in the "off" position, the "on" position, or the "both" position. In the "on" position and the "both" position the first link bar 140 and the second link bar 142 serve to bridge various gaps between the bus bars 144 as described further below.

The first bus bar 144*a*, the second bus bar 144*b*, the third bus bar 144*c*, and the fourth bus bar 144*d* are coupled to the first terminal 102*a*, second terminal 102*b*, third terminal 102*c*, and forth terminal 102*d*, respectively. Consequently, whatever of the first bus bar 144*a*, the second bus bar 144*b*, the third bus bar 144*c*, and the fourth bus bar 144*d* are bridged by the first link bar 140 and the second link bar 142 to be connected to one another, corresponding ones of the first terminal 102, the second terminal 102, the third terminal 102, and the forth terminal 102 are also connected to one another, respectively.

The compressed spring 135 further presses on a first side 139 of the keyed rotor 138 to maintain sufficient contact force for the first link bar 140 and the second link bar 142 to be in slidable contact with one or more of the bus bars 144*a*-144*d* dependent upon the rotational position of the knob 116. Slidable contact of the first link bar 140 and the second link bar 142 with one or more of the bus bars 144*a*-144*d* allows for rotational movement of the keyed rotor 138 about the keyed shaft 129 of the knob 116. Such rotational movement allows for change in position of the first link bar 140 and the second link bar 142, consequently changing which of the bus bars are being contacted by the first link bar and/or the second link bar. The keyed shaft 129 passes between the first bus bar 144*a*, the second bus bar 144*b*, the third bus bar 144*c*, and the fourth bus bar 144*d* and is pressed against the backplate 124. An o-ring 146 is positioned between the housing 108 and the backplate 124 to seal therebetween.

Figure 8:
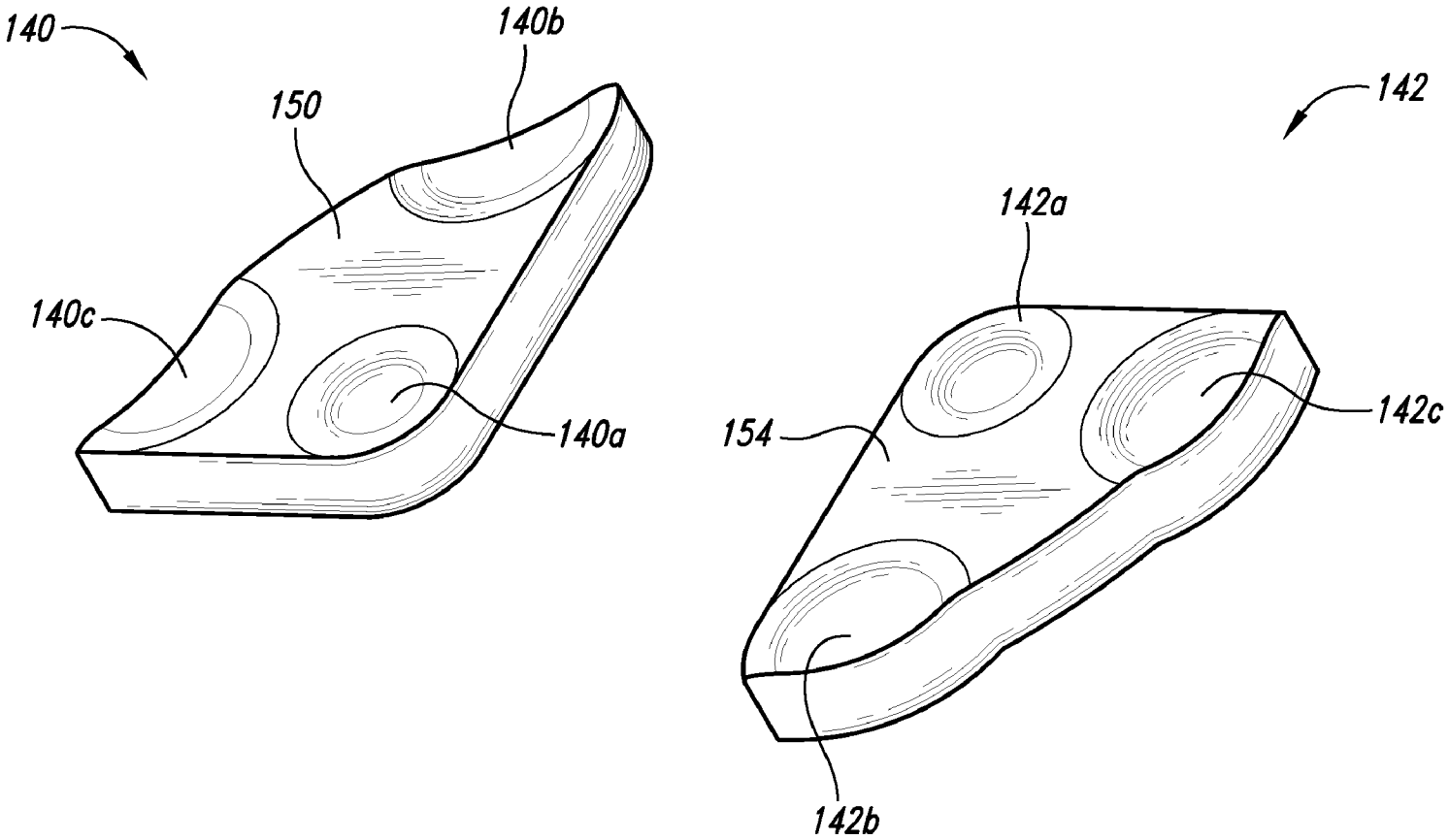
FIG. 8 is an enlarged top perspective view of link bars of the enhanced electrical rotary switch.
Figure 9:
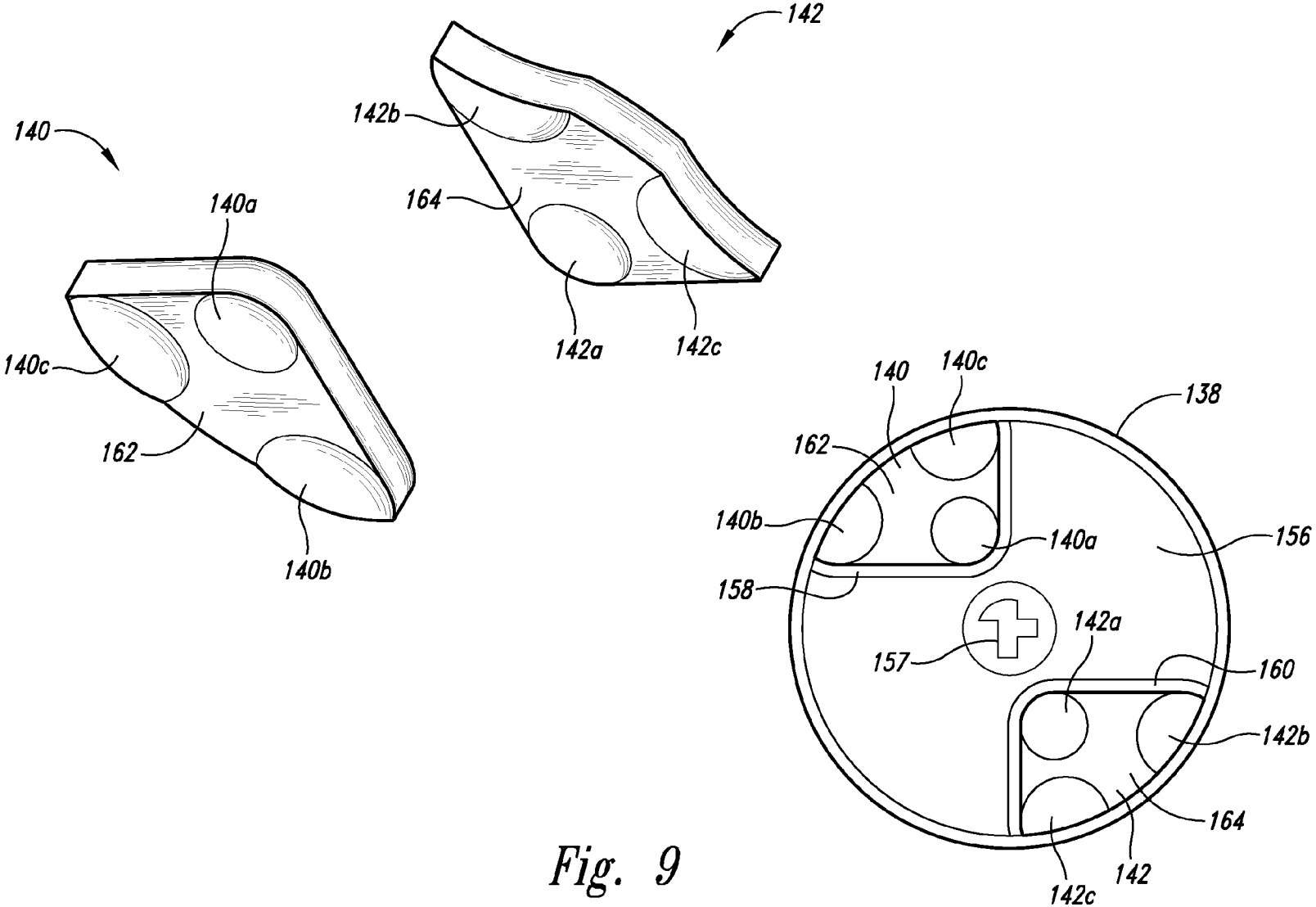
FIG. 9 is an enlarged bottom perspective view of the link bars of the enhanced electrical rotary switch along with a top plan view of a keyed rotor.

As shown in FIG. 8, the first link bar 140 has indents into a first surface 150 of the first link bar each indent forming a different one of a first contact 140*a*, a second contact 140*b*, and a third contact 140*c*. The second link bar 142 has indents 152 into a first surface 154 of the second link bar each indent forming a different one of a first contact 142*a*, a second contact 142*b*, and a third contact 142*c*. As shown in FIG. 9, on a second side 156 of the keyed rotor 138 opposite the first side 139, the keyed rotor has a keyed hole 157, a first compartment 158 and a second compartment 160. The first compartment 158 contains the first link bar 140 with the first surface 150 of the first link bar adjacent the second side 156 of the keyed rotor 138. The first link bar 140 has a second surface 162 with the first contact 140*a*, the second contact 140*b*, and the third contact 140*c* protruding from the second surface positioned correspondingly according to position of corresponding ones of the indents on the first surface 150.

The second compartment 158 of the keyed rotor 138 contains the second link bar 142 with the first surface 154 of the second link bar adjacent the second side of the keyed rotor. The second link bar 142 has a second surface 144 with the first contact 142*a*, the second contact 142*b*, and the third contact 142*c* protruding from the second surface positioned correspondingly according to position of corresponding ones of the indents on the first surface 154.

Figure 10:
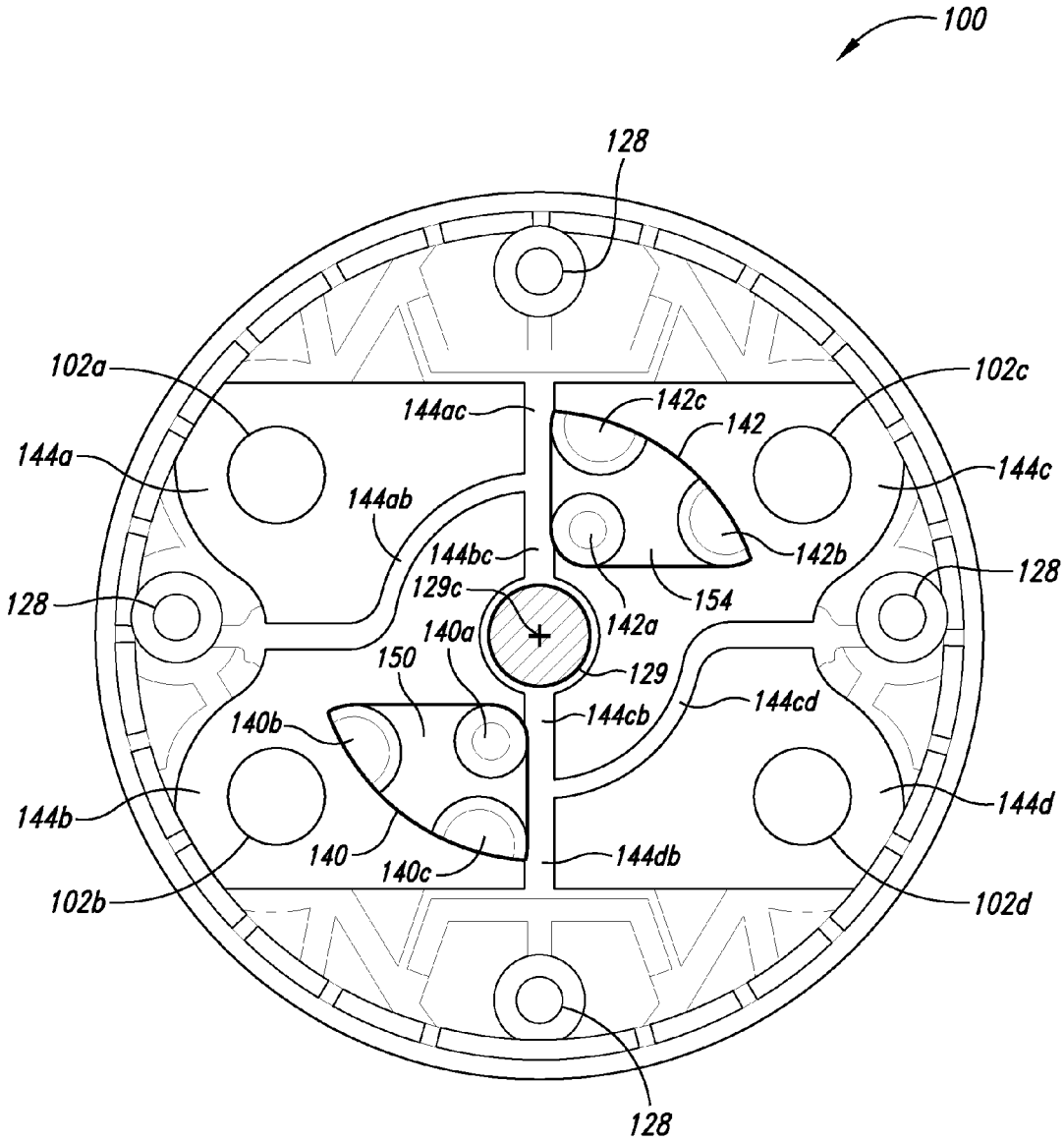
FIG. 10 is a top plan sectional view of the enhanced electrical rotary switch of FIG. 7 taken along the 10-10 line showing the link bars are in the "off" position.

In the "off" position as shown in FIG. 10, the first contact 140*a*, the second contact 140*b*, and the third contact 140*c* of the first link bar 140 are all in contact with the second bus bar 144*b*. Consequently, no gaps between the bus bars 144*a*-144*d* are bridged and no electrical paths between any of the terminals 102*a*-102*d* are established by the first link bar 140 in the "off" position. The first contact 142*a*, the second contact 142*b*, and the third contact 142*c* of the second link bar 142 are all in contact with the third bus bar 144*c* in the "off" position. Consequently, no gaps between the bus bars 144*a*-144*d* are bridged so that the bus bars are electrically separated and no electrical paths between any of the terminals 102*a*-102*d* are established by the second link bar 142 in the "off" position.

Figure 11:
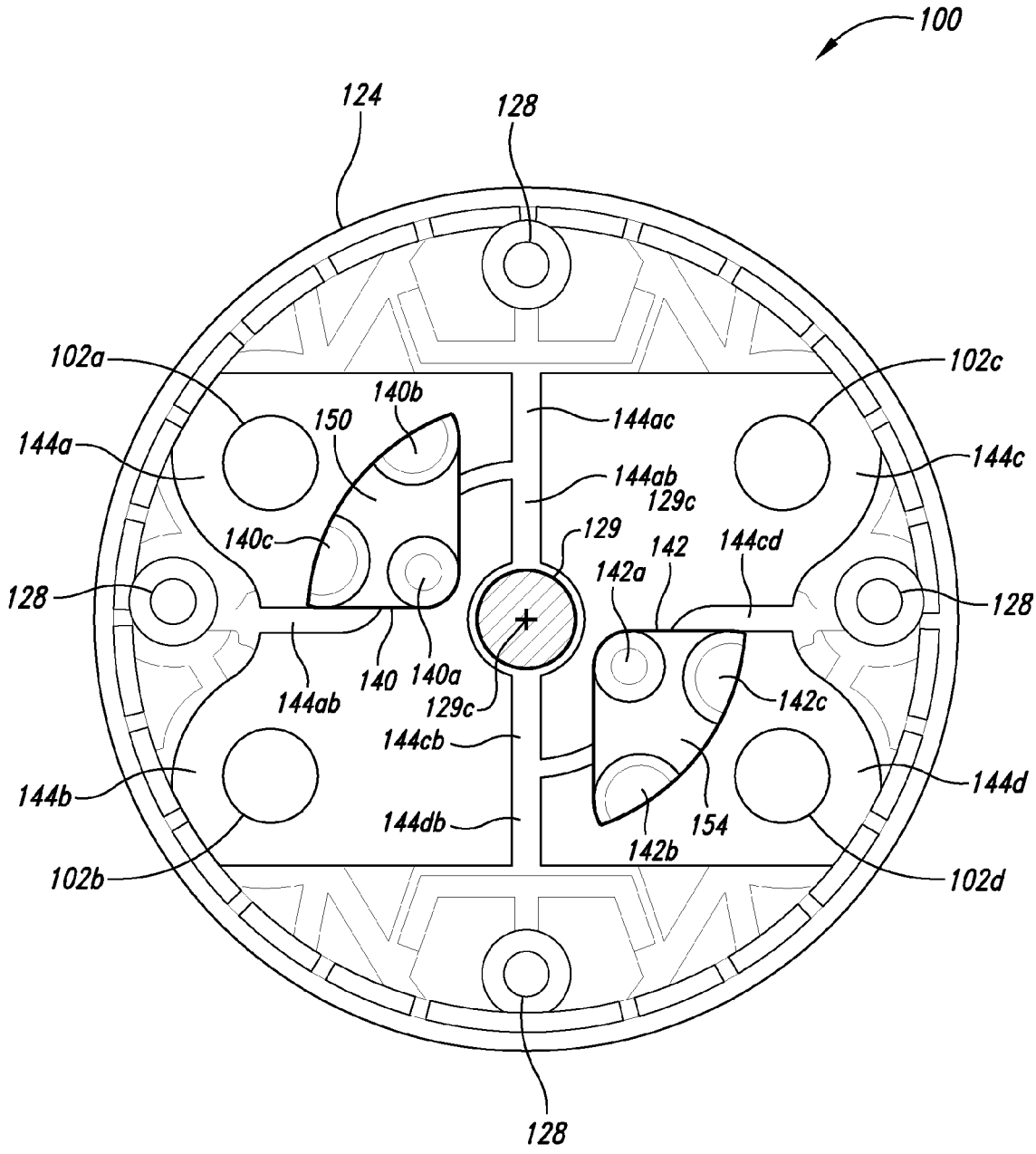
FIG. 11 is a top plan sectional view of the enhanced electrical rotary switch of FIG. 7 taken along the 11-11 line showing the link bars are in the "on" position.

In the "on" position as shown in FIG. 11, the first contact 140*a* of the first link bar 140 is in contact with the second bus bar 144*b*, and the second contact 140*b* and the third contact 140*c* of the first link bar 140 are in contact with the first bus bar 144*a*. Consequently, the first link bar 140 in the "on" position bridges a first gap 144*ab* between the first bus bar 144*a* and the second bus bar 144*b* thereby establishing the first electrical path 106*ab* between the first terminal 102*a* and the second terminal 102*b*. In the "on" position, the first contact 142*a* of the second link bar 142 is in contact with the third bus bar 144*c*, the second contact 142*b* and the third contact 142*c* of the second link bar 142 are in contact with the fourth bus bar 144*d*. Consequently, the second link bar 142 in the "on" position bridges a second gap 144*cd* between the third bus bar 144*c* and the fourth bus bar 144*d* establishing the second electrical path 106*cd* between the third terminal 102*c* and the fourth terminal 102*d*.

Figure 12:
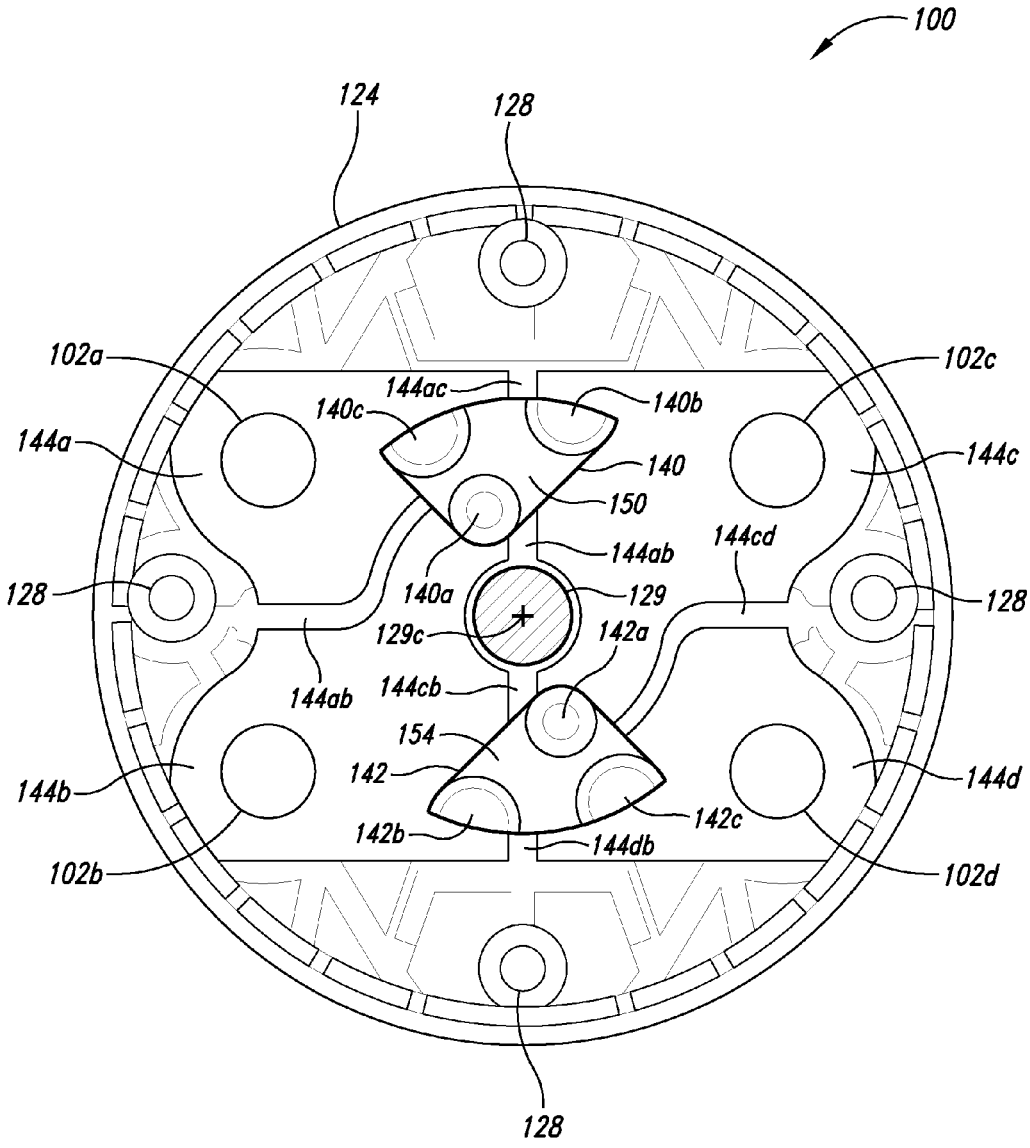
FIG. 12 is a top plan sectional view of the enhanced electrical rotary switch of FIG. 7 taken along the 12-12 line showing the link bars are in the "both" position.

In the "both" position as shown in FIG. 12, the first contact 140*a* of the first link bar 140 is in contact with the second bus bar 144*b*, the second contact 140*b* is in contact with the third bus bar 144*c*, and the third contact 140*c* is in contact with the first bus bar 144*a*. Consequently, in the "both" position, the first link bar 140 bridges a third gap 144*ac* between the first bus bar 144*a* and the third bus bar 144*c* to establish the third electrical path 106*ac* between the first terminal 102*a* and the third terminal 102*c* and bridges a fourth gap 144*cb* between the third bus bar and the second bus bar 144*b* to establish the fourth electrical path 106*bc* between the second terminal 102*b* and the third terminal 102*c*.

In the "both" position, the first contact 142*a* of the second link bar 142 is in contact with the third bus bar 144*c*, the second contact 142*b* is in contact with the second bus bar 144*b*, and the third contact 142*c* is in contact with the fourth bus bar 144*d*. Consequently, in the "both" position, the second link bar 142 bridges a fifth gap 144*db* between the fourth bus bar 144*d* and the second bus bar 144*b* to establish the fifth electrical path 106*db* between the forth terminal 102*d* in the second terminal 102*b* and bridges a sixth gap 144*cb* between the third bus bar 144*c* and the second bus bar 144*b* to establish a sixth electrical path 106*cb* between the third terminal 102*c* and the second terminal 102*b*.

Figure 13:
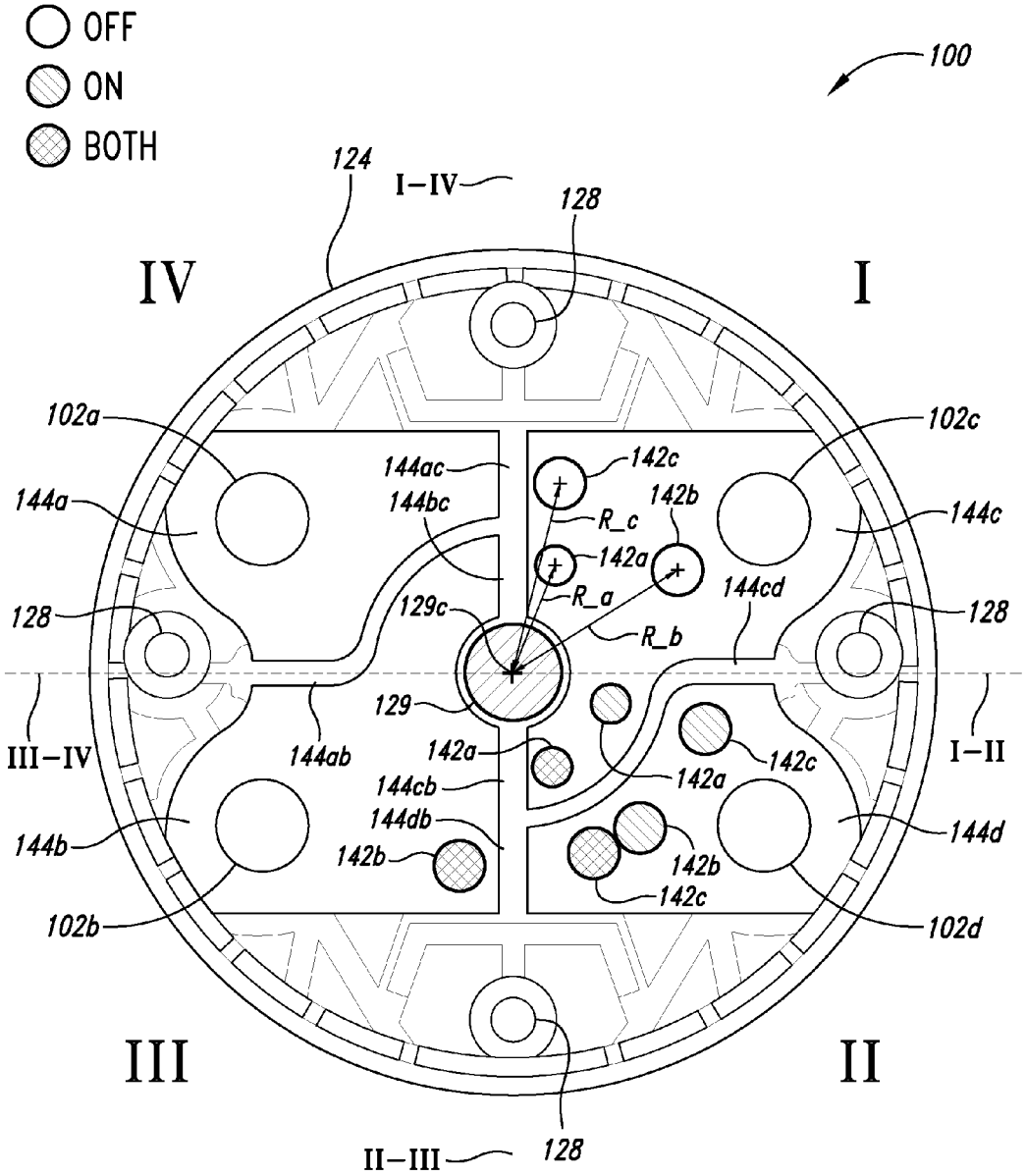
FIG. 13 is a top plan sectional view of the enhanced electrical rotary switch of FIG. 7 taken along the 13-13 line showing contacts of one of the link bars in the "off", "on", and "both" positions.
Figure 13A:
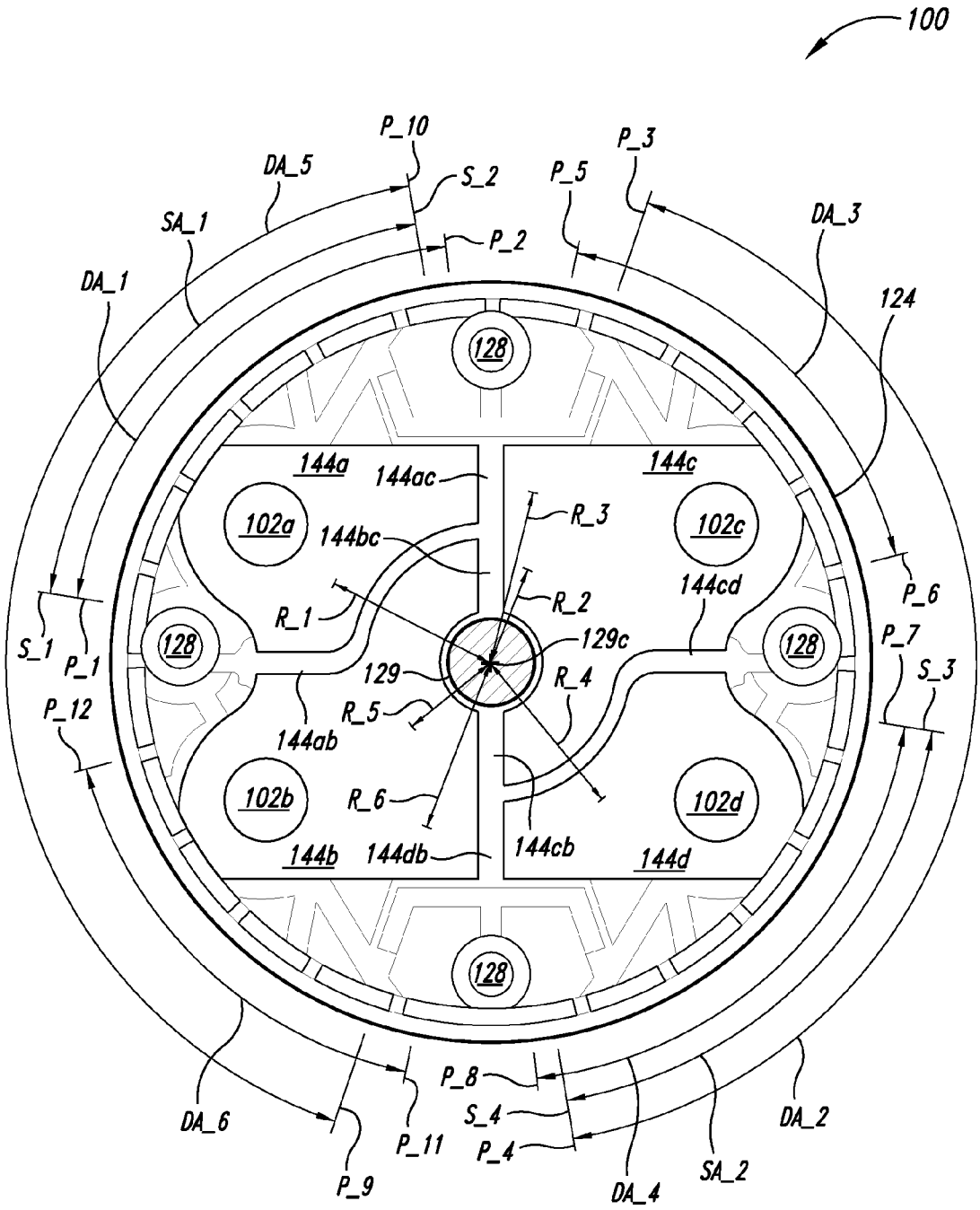
FIG. 13A is a top plan section view of the enhanced electrical rotary switch of FIG. 7 taken along the 13A-13A line providing illustrative angular dimensions.

As further reference, positions of the first contact 142*a*, the second contact 142*b*, and the third contact 142*c* of the second link bar 142 are comparatively shown in FIG. 13 for the "off" position, the "on" position, and the "both" position. Although the contacts 140*a*-140*c* for the first link bar 140 are not shown in FIG. 13, comments regarding the second link bar can be appropriately applied to the first link bar 140 if it is remembered that the contacts 140*a*-140*c* for the first link bar are angularly positioned about the keyed shaft 129, substantially 180 degrees from respective ones of the contacts 142*a*-142*c* of the second link bar 142.

For illustrative purposes, the first implementation 100 is divided by a first quadrant line I-II, a second quadrant line II-III, a third quadrant line III-IV, and a fourth quadrant line I-IV into a first quadrant I, a second quadrant II, a third quadrant III, and a fourth quadrant IV. In other implementations other shaped quadrants maybe used. In the depicted implementation 100, the first quadrant line I-II is co-axial with the third quadrant line III-IV, the second quadrant line II-III is co-axial with the fourth quadrant line I-IV, and the first quadrant line I-II is perpendicular with the second quadrant line II-III.

As shown, the keyed shaft 129 has a center axis 129*c*. The first contact 142*a* is located in the "off" position, "on" position, and "both" position at a constant radius, R_a, distance from the center axis 129*c*. The second contact 142*b* is located in the "off" position, "on" position, and "both" position at a constant radius, R_b, distance from the center axis 129*c*. The third contact 142*a* is located in the "off" position, "on" position, and "both" position at a constant radius, R_c, distance from the center axis 129*c*.

In other implementations, the keyed rotor 138, and/or the second link bar 142 may be so shaped such that the contacts 142*a*-142*c* may move in non-circular paths so that the respective R_a, R_b, and R_c distances change from the "off" position, the "on" position, and the "both" position. Quadrant shapes and placement, bus bar shapes and placement, and gap shapes and placement would be changed to accommodate such changes in R_a, R_b, and R_c.

Regarding the first quadrant I, the third bus bar 144*c* occupies sufficient first area to allow contact with the first contact 142*a*, the second contact 142*b*, and the third contact 142*c* in the "off" position. Some second area of the first quadrant I occupied by the third bus bar 144*c* allows for sliding of the second link bus 142 to other positions. The second area at least includes a first portion that is spaced from the center axis 129*c* of the shaft 129 at the constant radial distance R_a with sufficient dimensional width to accommodate size of the first contact 142*a*. The first portion of the second area of the third bus bar 144*c* angularly extends substantially 180 degrees clockwise about the center axis 129*c* from the fourth gap 144*bc* at the fourth quadrant line I-IV into the second quadrant II to the sixth gap 144*cb* at the second quadrant line II-III in a continuous manner without any gaps. Although the first portion of the second area of the third bus bar 144*c* is depicted as angularly extending substantially 180 degrees, in some implementations it need only extend to accommodate the extent of actual travel of the first contact 142*a* as related to movement between positions for the first contact.

The second area of the third bus bar 144*c* at least includes a second portion that is spaced from the center axis 129*c* of the shaft 129 at the constant radial distance R_b with sufficient dimensional width to accommodate size of the second contact 142*b*. The second portion of the second area of the third bus bar 149*c* angularly extends substantially 90 degrees clockwise about the center axis 129*c* from the third gap 144*ac* at the fourth quadrant line I-IV to the second gap 144*cd* at the second quadrant line II-III in a continuous manner without any gaps. Although the second portion of the second area of the third bus bar 144*c* is depicted as angularly extending substantially 90 degrees, in some implementations it need only extend to accommodate the extent of actual travel of the second contact 142*b* as related to movement between positions.

The second area of the third bus bar 144*c* at least includes a third portion that is spaced from the center axis 129*c* of the shaft 129 at the constant radial distance R_c with sufficient dimensional width to accommodate size of the third contact 142*c*. The third portion of the second area of the third bus bar 144*c* angularly extends substantially 90 degrees clockwise about the center axis 129*c* from the third gap 144*ac* at the fourth quadrant line I-IV to the second gap 144*cd* at the second quadrant line II-III in a continuous manner without any gaps. Although the third portion of the second area of the third bus bar 144*c* is depicted as angularly extending substantially 90 degrees, in some implementations it need only extend to accommodate the extent of actual travel of the third contact 142*c* as related to movement between positions of the third contact.

The fourth bus bar 144*d* is located in the second quadrant 11 and has a first portion of area that is spaced from the center axis 129*c* of the shaft 129 at the constant radial distance R_b with sufficient dimensional width to accommodate size of the second contact 142*b*. The first portion of the fourth bus bar 144*d* angularly extends substantially 90 degrees clockwise about the center axis 129*c* from the second gap 144*cd* at the second quadrant line I-II to the fifth gap 144*db* at the third quadrant line II-III. Although the fourth bus bar 144*d* is depicted as angularly extending substantially 90 degrees, in some implementations it need only extend to accommodate the extent of actual travel of the second contact 142*b* as related to movement between positions of the second contact.

The fourth bus bar 144*d* has a second portion of area that is spaced from the center axis 129*c* of the shaft 129 at the constant radial distance R_c with sufficient dimensional width to accommodate size of the third contact 142*c*. The second portion of the fourth bus bar 144*d* angularly extends substantially 90 degrees clockwise about the center axis 129*c* from the second gap 144*cd* at the second quadrant line I-II to the fifth gap 144 db at the third quadrant line II-III. Although the fourth bus bar 144*c* is depicted as angularly extending substantially 90 degrees, in some implementations it need only extend to accommodate the extent of actual travel of the third contact 142*c* as related to movement between positions of the third contact.

The second bus bar 144*b* is located in the second quadrant II and has a first portion of area that is spaced from the center axis 129*c* of the shaft 129 at the constant radial distance R_b with sufficient dimensional width to accommodate size of the second contact 142*b*. The first portion of the fourth bus bar 144*d* angularly extends at least sufficiently clockwise about the center axis 129*c* from the fifth gap 144 db to accommodate travel of the second contact 142*b* through movement between positions of the second contact.

In other implementations, some areas of the bus bars 144*a*-144*d* that do not directly contact one of the contacts 142*a*-142*c* in the "on" position or the "both" position could be occupied by alternate materials other than those of the bus bars as long as the bus bars are sufficiently sized to carry rated electrical current, the other materials were appropriately sized to allow for sliding movement of the contacts, and the other materials were non-conductive or there is sufficient gap size between the bus bars.

Figure 14:
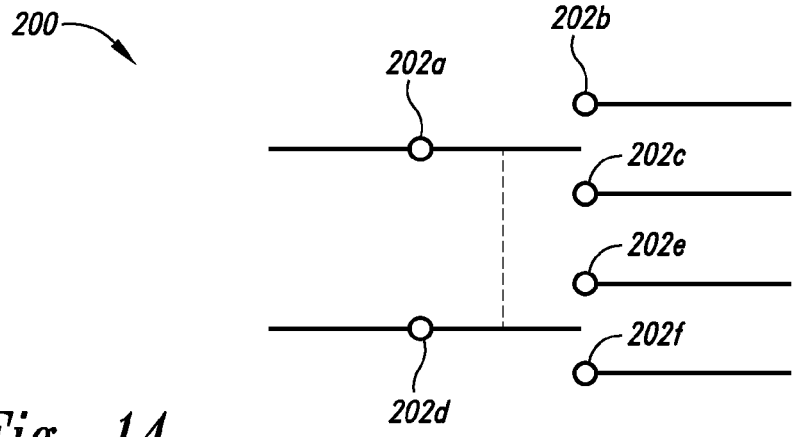
FIG. 14 is a partial circuit diagram of a double pole, double throw implementation of the enhanced electrical rotary switch in an "off" position.
Figure 15:
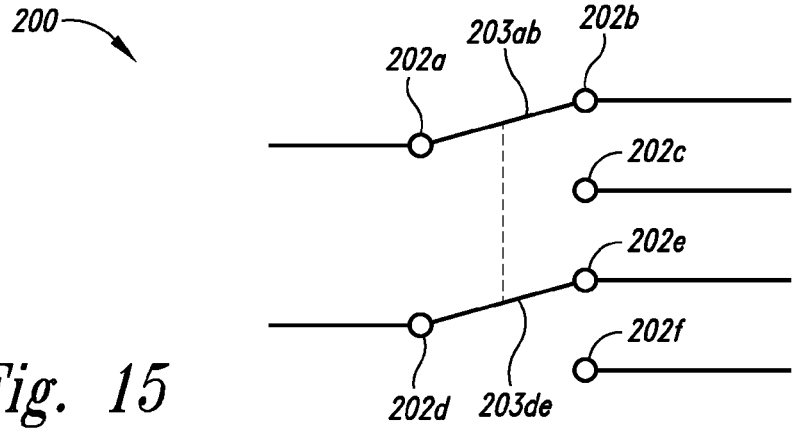
FIG. 15 is a partial circuit diagram of the double pole, double throw implementation of FIG. 14 in a "first on" position.
Figure 16:
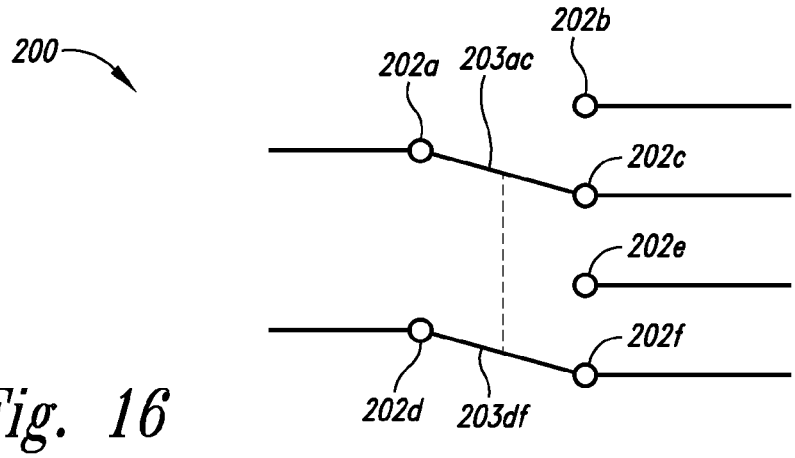
FIG. 16 is a partial circuit diagram of the double pole-double throw implementation of FIG. 14 in a "second on" position.

As shown in FIG. 13, the first bus bar 144*a* has a first portion located to include a first radial distance R_1 from the center axis 129*c* axis angularly extending about the center axis a first degree amount DA_1 from a first angular position P_1 through a first shared angular position S_1 and through a second shared angular position S_2 a first shared degree amount SA_1 to a second angular position P_2, The third bus bar 144*c* has a first portion located to include a second radial distance R_2 from the axis angularly extending about the axis a second degree amount DA_2 from a third angular position P_3 through a third shared angular position S_3 and through a fourth shared angular position S_4 a second shared degree amount S_A to a fourth angular position P_4. The third bus bar 144*c* has a second portion located to include a third radial distance R_3 from the center axis 129*c* angularly extending about the center axis a third degree amount DA_3 from a fifth angular position P_5 to a sixth angular position P_6, the third radial distance R_3 being greater than the second radial distance R_2, The fourth bus bar 144*d* has a first portion located to include a fourth radial distance R_4 from the center axis 129*c* angularly extending about the center axis a fourth degree amount DA_4 from a seventh angular position P_7 through the third shared angular position S_3 and through the fourth shared angular position S_4 the second shared degree amount SA_2 to an eighth angular position P_8, The second bus bar 144*b* has a first portion located to include a fifth radial distance R_5 from the center axis 129*c* angularly extending about the center axis a fifth degree amount DA_5 from a ninth angular position P_9 through the first shared angular position S_1 and through the second shared angular position S_2 the first shared angular amount SA_1 to a tenth angular position P_10. The second bus bar 144*b* has a second portion located to include a sixth radial distance R_6 from the center axis 12*c* angularly extending about the center axis an sixth degree amount DA_6 from an eleventh angular position P_11 to a twelfth angular position P_12, the sixth radial distance being greater than the fifth radial distance, A partial circuit diagram of a second implementation 200 of the enhanced switch as a double-pole double-throw switch is shown in FIGS. 14-16 as having a first terminal 202*a*, a second terminal 202*b*, a third terminal 202*c*, a fourth terminal 202*d*, a fifth terminal 202*e*, and a sixth terminal 202*f*. In an "off" position shown in FIG. 14, the second implementation 200 has no electrical paths between the terminals 202. In a "first on" position shown in FIG. 15, the second implementation 200 has a first electrical path 203*ab* and a second electrical path 203*de*. The first electrical path 203*ab* is between the first terminal 202*a* and the second terminal 202*b*. The second electrical path 202*de* is between the fourth terminal 202*d* and the fifth terminal 202*e*. In a "second on" position shown in FIG. 16, the second implementation 200 has a third electrical path 203*ac* and a fourth electrical path 203*df*. The third electrical path 203*ac* is between the first terminal 202*a* and the third terminal 202*c*. The fourth electrical path 202*df* is between the fourth terminal 202*d* and the sixth terminal 202*f*.

Figure 17:
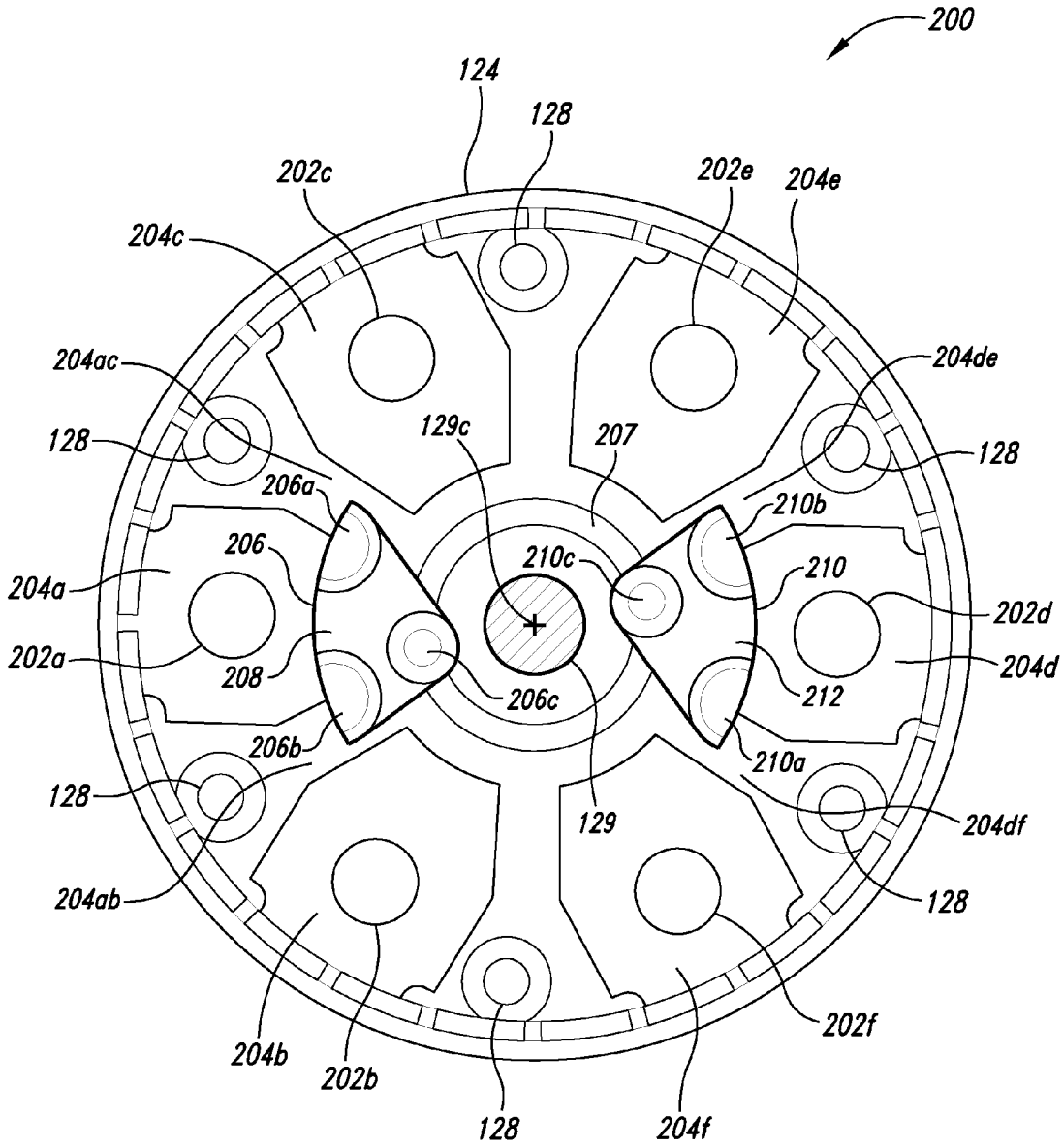
FIG. 17 is a top plan sectional view of the a double pole-double throw implementation of the enhanced electrical rotary switch showing the link bars in the "off" position.
Figure 18:
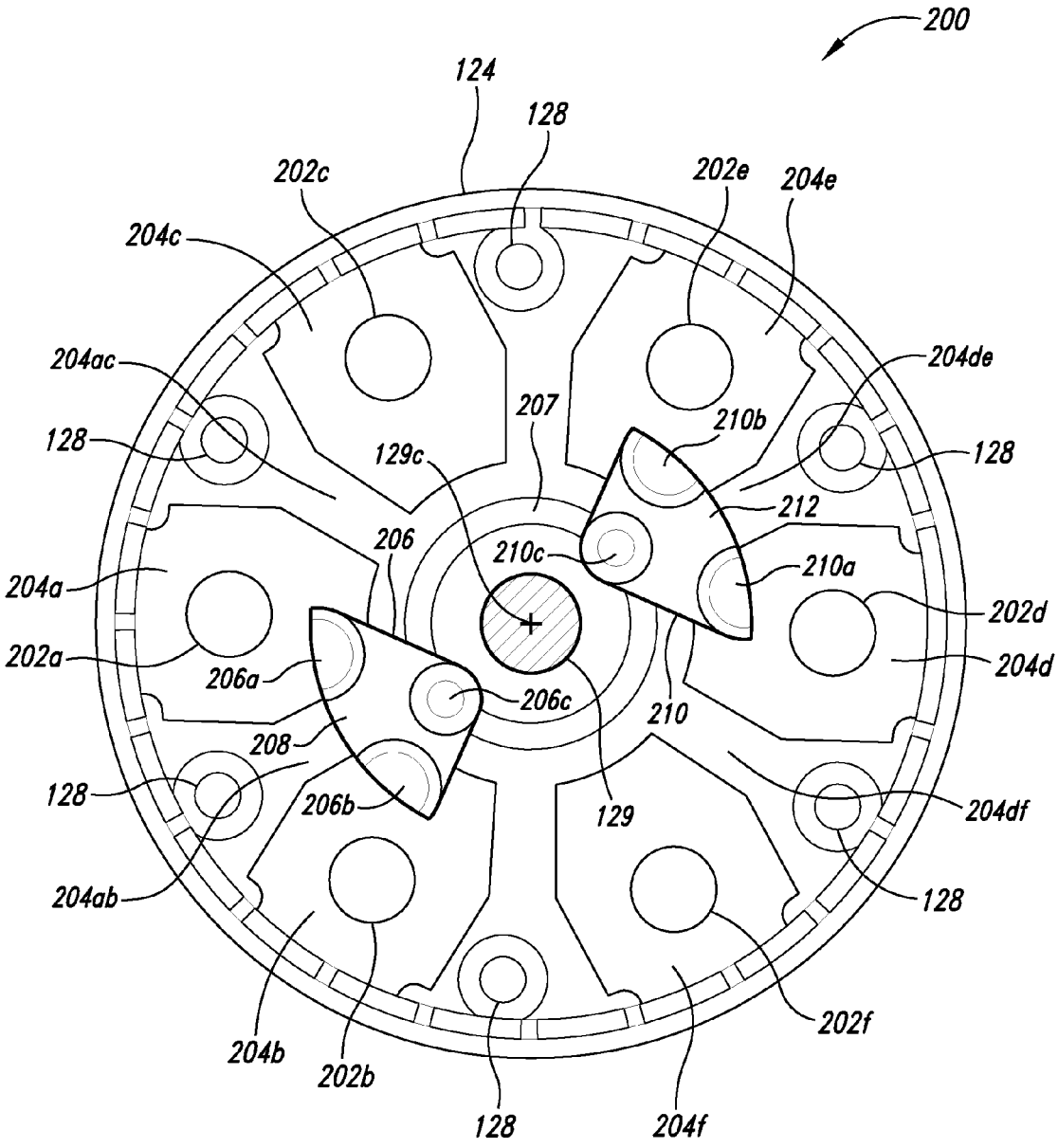
FIG. 18 is a top plan sectional view of a double pole-double throw implementation of FIG. 17 showing the link bars in the "first on" position.
Figure 19:
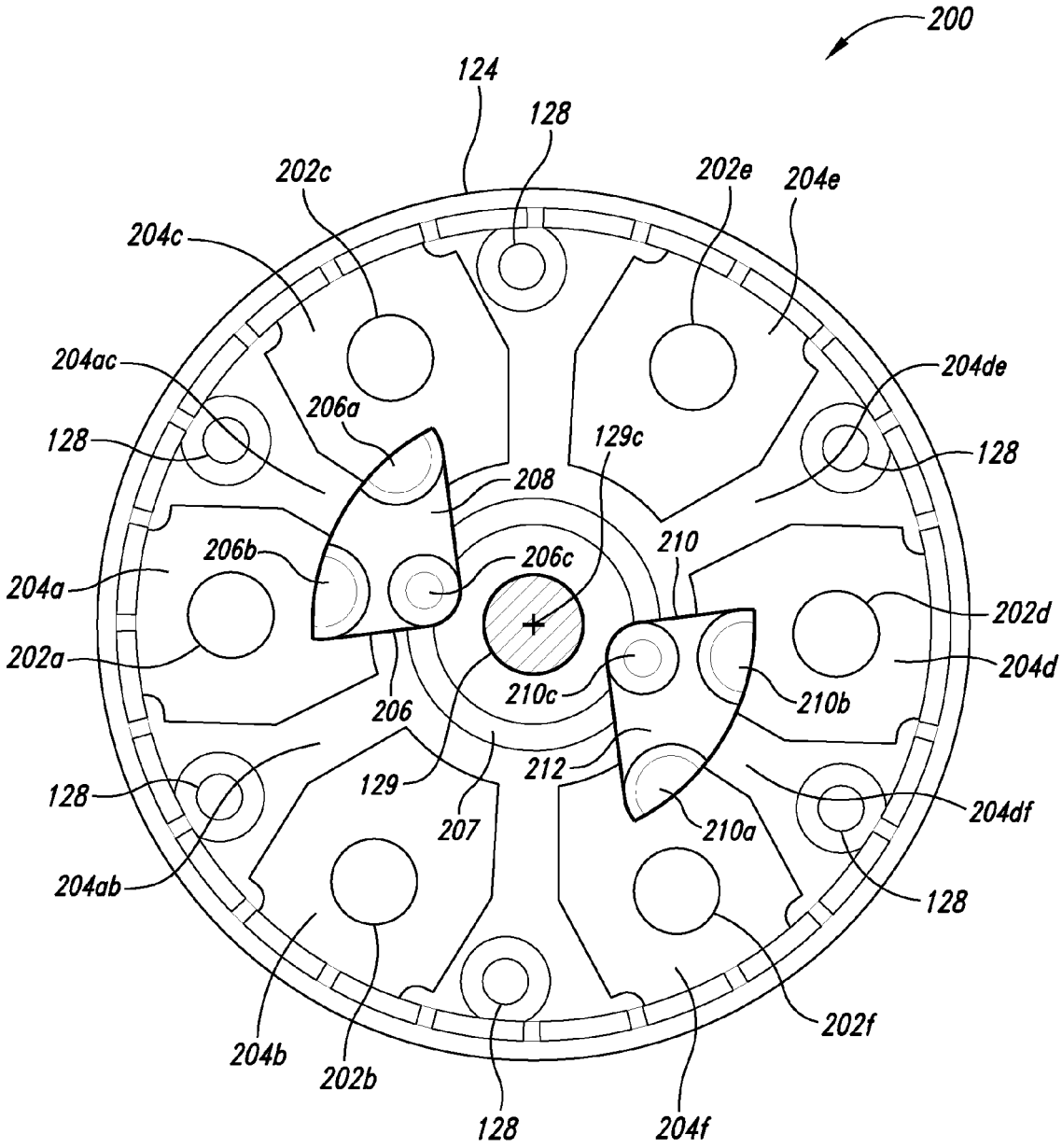
FIG. 19 is a top plan sectional view of a double pole-double throw implementation of FIG. 17 showing the link bars in the "second on" position.

Corresponding sectional views of the second implementation 200 are found in FIG. 17 ("off" position), FIG. 18 ("first on" position) and FIG. 19 ("second on" position). The second implementation 200 includes a version of the keyed rotor 138 and versions of other components discussed above for the first implementation 100, which are understood to be included with the second implementation as well. The second implementation 200 includes the first terminal 202*a* electrically coupled to a first bus bar 204*a*, the second terminal 202*b* electrically coupled to a second bus bar 204*b*, the third terminal 202*c* electrically coupled to a third bus bar 204*c*, the fourth terminal 202*d* electrically coupled to a fourth bus bar 204*d*, the fifth terminal 202*e* electrically coupled to a fifth bus bar 204*e*, and the sixth terminal 202*f* electrically coupled to a sixth bus bar 204*f*. The first bus bar 204*a* and the second bus bar 204*b* have a first gap 204*ab* therebetween. The fourth bus bar 204*d* and the fifth bus bar 204*e* have a second gap 204*de* therebetween. The first bus bar 204*a* and the third bus bar 204*c* have a third gap 204*ac* therebetween. The fourth bus bar 204*d* and the sixth bus bar 204*f* have a fourth gap 204*df* therebetween.

The second implementation 200 has a first link bar 206 with indents on a first surface 208 with corresponding bumps as a first contact 206*a* and a second contact 206*b* that protrude from a second surface (not shown) opposite the first surface. A circular member 206*c* (shown, in part, on the first surface 208) protrudes from the second surface of the first link bar 206 and rides upon a insulated track 207 to help position the first link bar.

The second implementation 200 has a second link bar 210 with indents on a first surface 212 with corresponding bumps as a first contact 210*a* and a second contact 210*b* that protrude from a second surface (not shown) opposite the first surface. A circular member 210*c* (shown, in part, on the first surface 212) protrudes from the second surface of the second link bar 210 and rides upon a insulated track 207 to help position the second link bar.

As shown in FIG. 17, when the second implementation 200 is in the "off" position, the first link bar 206 is positioned so that the first contact 206*a* and the second contact 206*b* contact the first bus bar 204*a* and the second link bar 210 is positioned so that the first contact 210*a* and the second contact 210*b* contact the fourth bus bar 204*d*. Consequently, in the "off" position, the first link bar 206 and the second link bar 210 do not bridge any gaps between any of the bus bars 204 to establish any electrical paths between the bus bars.

As shown in FIG. 18, when the second implementation 200 is in the "first on" position, the first link bar 206 is positioned so that the first contact 206*a* contacts the first bus bar 204*a* and the second contact 206*b* contacts the second bus bar 204*b*. Consequently, the first link bar 206 bridges the first gap 204*ab* to establish the first electrical path 203*ab*. In the "first on" position, the second link bar 210 is positioned so that the first contact 210*a* contacts the fourth bus bar 202*d* and the second contact 202*b* contacts the fifth bus bar 202*e*. Consequently, the second link bar 210 bridges the second gap 204*de* to establish the second electrical path 203*de*.

As shown in FIG. 19, when the second implementation 200 is in the "second on" position, the first link bar 206 is positioned so that the first contact 206*a* contacts the third bus bar 204*c* and the second contact 206*b* contacts the first bus bar 204*a*. Consequently, the first link bar 206 bridges the third gap 204*ac* to establish the third electrical path 203*ac*. In the "second on" position, the second link bar 210 is positioned so that the first contact 210*a* contacts the sixth bus bar 204*f* and the second contact 202*b* contacts the fourth bus bar 204*d*. Consequently, the second link bar 210 bridges the fourth gap 204*df* to establish the fourth electrical path 203*df*.

From the foregoing it will be appreciated that, although specific embodiments of the invention have been described herein for purposes of illustration, various modifications may be made without deviating from the spirit and scope of the invention. For instance, some alternatives of the second implementation 200 have link bars without circular members riding on insulated tracks, but rather guide the link bars through other mechanisms. As another example, additional variations of the enhanced switch may include at least some bus bars that extend to maintain contact with link bars in additional positions. As a further example, the enhanced switch was depicted as having conductive terminals having threaded studs to couple with bus bars. In other implementations, other approaches for electrical coupling can be utilized. Additionally, contacts were depicted as being part of the link bars, however, in other implementations, the contacts could be part of the bus bars. Furthermore, other variations could include hex bolts, welded threaded rods or other alternatives to those approaches depicted herein. Accordingly, the invention is not limited except as by the appended claims.

The invention claimed is:

1. A rotary electrical switch comprising:

an elongated member longitudinally extending along an axis and rotatable about the axis;

a plurality of terminals including a first terminal, a second terminal, a third terminal, and a fourth terminal;

a plurality of bus members including a first bus member electrically coupled to the first terminal, a second bus member electrically coupled to the second terminal, a third bus member electrically coupled to the third terminal, and a fourth bus member electrically coupled to the fourth terminal, the first bus member having a first portion located to include a first radial distance from the axis angularly extending about the axis a first degree amount from a first angular position through a first shared angular position and through a second shared angular position a first shared degree amount to a second angular position, the third bus member having a first portion located to include a second radial distance from the axis angularly extending about the axis a second degree amount from a third angular position through a third shared angular position and through a fourth shared angular position a second shared degree amount to a fourth angular position; the third bus member having a second portion located to include a third radial distance from the axis angularly extending about the axis a third degree amount from a fifth angular position to a sixth angular position, the third radial distance being greater than the second radial distance, the fourth bus member having a first portion located to include a fourth radial distance from the axis angularly extending about the axis a fourth degree amount from a seventh angular position through the third shared angular position and through the fourth shared angular position the second shared degree amount to an eighth angular position, the second bus member having a first portion located to include a fifth radial distance from the axis angularly extending about the axis a fifth degree amount from a ninth angular position through the first shared angular position and through the second shared angular position the first shared angular amount to a tenth angular position; the second bus member having a second portion located to include a sixth radial distance from the axis angularly extending about the axis a sixth degree amount from an eleventh angular position to a twelfth angular position, the sixth radial distance being greater than the fifth radial distance, the first bus member spaced from the second bus member and the third bus member, the third bus member spaced from the fourth bus member, and the second bus member spaced from the third bus member and the fourth bus member; and a first link member and a second link member, the first link member constrained to be movable in a first angular path about the axis and the second link member constrained to be movable in an angular path about the axis, in a first position, the first link member located to be electrically coupled with the second bus member through slidable contact and to be electrically separated from the first bus member, the third bus member, and the fourth bus member, in the first position, the second link member located to be electrically coupled with the third bus member through slidable contact and to be electrically separated with the first bus member, the second bus member, and the fourth bus member, thereby having the first terminal, the second terminal, the third terminal, and the fourth terminal being electrically separated from one another, in a second position, the first link member located to be electrically coupled with the first bus member through slidable contact, to be electrically coupled with the second bus member through slidable contact and to be electrically separated from the third bus member and the fourth bus member, in the second position, the second link member located to be electrically coupled with the third bus member through slidable contact, to be electrically coupled with the fourth bus member through slidable contact and to be electrically separated from the first bus member and the second bus member, thereby having the first terminal being electrically coupled with the second terminal, the third terminal, being electrically coupled with the fourth terminal, the first terminal being electrically separated from the third terminal, and the first terminal being electrically separated from the fourth terminal, and in a third position, the first link member located to be electrically coupled with the first bus member through slidable contact, to be electrically coupled with the second bus member through slidable contact, to be electrically coupled with the third bus member through slidable contact, and positioned without slidable contact with the fourth bus member, in the third position, the second link member located to be electrically coupled with the second bus member through slidable contact, to be electrically coupled with the third bus member through slidable contact, to be electrically coupled with the fourth bus member through slidable contact and positioned without slidable contact with the first bus member thereby having the first terminal, the second terminal, the third terminal, and the fourth terminal being electrically coupled with one another.

2. A rotary electrical switch comprising:

an elongated member longitudinally extending along an axis and rotatable about the axis;

a plurality of terminals including a first terminal, a second terminal, a third terminal, and a fourth terminal;

a plurality of bus members including a first bus member electrically coupled to the first terminal, a second bus member electrically coupled to the second terminal, a third bus member electrically coupled to the third terminal, and a fourth bus member electrically coupled to the fourth terminal, a first link member and a second link member coupled to the elongated member to move the first link member and the second link member about the axis as the elongated member rotates, in a first rotational position of the elongated member about the axis, the first link member located to be electrically coupled with the second bus member and to be electrically separated from the first bus member, the third bus member, and the fourth bus member, in the first position, the second link member located to be electrically coupled with the third bus member and to be electrically separated with the first bus member, the second bus member, and the fourth bus member, thereby having the first terminal, the second terminal, the third terminal, and the fourth terminal being electrically separated from one another, in a second rotational position of the elongated member about the axis, the first link member located to be electrically coupled with the first bus member, to be electrically coupled with the second bus member, and to be electrically separated from the third bus member and the fourth bus member, in the second position, the second link member located to be electrically coupled with the third bus member, to be electrically coupled with the fourth bus member and to be electrically separated from the first bus member and the second bus member, thereby having the first terminal being electrically coupled with the second terminal, the third terminal, being electrically coupled with the fourth terminal, the first terminal being electrically separated from the third terminal, and the first terminal being electrically separated from the fourth terminal, and in a third position rotational position of elongated member about the axis, the first link member located to be electrically coupled with the first bus member, to be electrically coupled with the second bus member, and to be electrically coupled with the third bus member, in the third position, the second link member located to be electrically coupled with the second bus member, to be electrically coupled with the third bus member, and to be electrically coupled with the fourth bus member thereby having the first terminal, the second terminal, the third terminal, and the fourth terminal being electrically coupled with one another.

3. A method comprising:

rotating an elongated member about a longitudinal axis to a first position to move a first link member and a second link member coupled to the elongated member about the axis to locate the first link member to be electrically coupled with a second bus member and to be electrically separated from a first bus member, a third bus member, and a fourth bus member, and to move a second link member coupled to the elongated member about the axis to be electrically coupled with the third bus member and to be electrically separated with the first bus member, the second bus member, and the fourth bus member, thereby having a first terminal electrically coupled to the first bus member, a second terminal electrically coupled to the second bus member, a third terminal electrically coupled to the third bus member, and a fourth terminal electrically coupled to the fourth bus member being electrically separated from one another;

rotating the elongated member about the longitudinal axis to move the first link member about the axis to locate the first link member Ito be electrically coupled with the first bus member, to be electrically coupled with the second bus member, and to be electrically separated from the third bus member and the fourth bus member, and to move the second link member about the axis to locate the second link member to be electrically coupled with the third bus member, to be electrically coupled with the fourth bus member and to be electrically separated from the first bus member and the second bus member, thereby having the first terminal being electrically coupled with the second terminal, the third terminal, being electrically coupled with the fourth terminal, the first terminal being electrically separated from the third terminal, and the first terminal being electrically separated from the fourth terminal, and rotating the elongated member about the longitudinal axis to move the first link member about the axis to locate the first link member Ito be electrically coupled with the first bus member, to be electrically coupled with the second bus member, and to be electrically coupled with the third bus member and to move the second link member about the axis to locate second link member to be electrically coupled with the second bus member, to be electrically coupled with the third bus member, and to be electrically coupled with the fourth bus member thereby having the first terminal, the second terminal, the third terminal, and the fourth terminal being electrically coupled with one another.

4. A system comprising:

a means for rotating an elongated member about a longitudinal axis to a first position to move a first link member and a second link member coupled to the elongated member about the axis to locate the first link member to be electrically coupled with a second bus member and to be electrically separated from a first bus member, a third bus member, and a fourth bus member, and to move a second link member coupled to the elongated member about the axis to be electrically coupled with the third bus member and to be electrically separated with the first bus member, the second bus member, and the fourth bus member, thereby having a first terminal electrically coupled to the first bus member, a second terminal electrically coupled to the second bus member, a third terminal electrically coupled to the third bus member, and a fourth terminal electrically coupled to the fourth bus member being electrically separated from one another;

a means for rotating the elongated member about the longitudinal axis to move the first link member about the axis to locate the first link member Ito be electrically coupled with the first bus member, to be electrically coupled with the second bus member, and to be electrically separated from the third bus member and the fourth bus member, and to move the second link member about the axis to locate the second link member to be electrically coupled with the third bus member, to be electrically coupled with the fourth bus member and to be electrically separated from the first bus member and the second bus member, thereby having the first terminal being electrically coupled with the second terminal, the third terminal, being electrically coupled with the fourth terminal, the first terminal being electrically separated from the third terminal, and the first terminal being electrically separated from the fourth terminal, and a means for rotating the elongated member about the longitudinal axis to move the first link member about the axis to locate the first link member Ito be electrically coupled with the first bus member, to be electrically coupled with the second bus member, and to be electrically coupled with the third bus member and to move the second link member about the axis to locate second link member to be electrically coupled with the second bus member, to be electrically coupled with the third bus member, and to be electrically coupled with the fourth bus member thereby having the first terminal, the second terminal, the third terminal, and the fourth terminal being electrically coupled with one another.

* * * * *